US005163304A

United States Patent [19]

Phillippe

[11] Patent Number: 5,163,304

[45] Date of Patent: Nov. 17, 1992

[54] REFRIGERATION SYSTEM EFFICIENCY ENHANCER

[76] Inventor: Gary Phillippe, 7263 Larchmont Dr., North Highlands, Calif. 95660

[21] Appl. No.: 728,737

[22] Filed: Jul. 12, 1991

[51] Int. Cl.[5] ..... F25B 39/04

[52] U.S. Cl. ..... 62/509; 251/65; 137/533.19

[58] Field of Search ..... 62/509; 137/533.19; 251/65

[56] References Cited

U.S. PATENT DOCUMENTS

| | | | |
|---|---|---|---|
| 2,748,572 | 6/1956 | Parcaro | 62/509 |
| 2,949,931 | 8/1960 | Rupright | 137/533.19 |
| 3,024,619 | 3/1962 | Gerteis et al. . | |
| 3,238,737 | 3/1966 | Shrader et al. | 62/509 |
| 3,365,902 | 1/1968 | Nussbaum . | |
| 3,537,274 | 11/1970 | Tilney . | |
| 3,918,268 | 11/1975 | Nussbaum . | |
| 4,171,622 | 10/1979 | Yamaguchi et al. . | |
| 4,173,865 | 11/1979 | Sawyer . | |
| 4,266,405 | 5/1981 | Trask . | |
| 4,449,377 | 5/1984 | Draper . | |
| 4,553,401 | 11/1985 | Fisher . | |
| 4,563,879 | 1/1986 | Hama et al. . | |
| 4,761,964 | 8/1988 | Pacheco . | |
| 4,831,835 | 5/1989 | Beehler | 62/509 |

FOREIGN PATENT DOCUMENTS 53-38143 4/1978 Japan .

OTHER PUBLICATIONS

Watsco Co. Catalog p. 17.

*Primary Examiner*—Ronald C. Capossela
*Attorney, Agent, or Firm*—James M. Ritchey

[57] ABSTRACT

For use with a refrigeration system to increase cooling efficiency, between an outdoor condenser and an indoor evaporator, a refrigerant receiver-sub-cooler is provided including, immediately before the receiver-sub-cooler, but still within the high pressure liquid refrigerant portion of the system, a high flow, low pressure release check valve, having a generally flat backside refrigerant flow control element, that serves as an incremental expansion device to cool partially the high pressure liquid refrigerant before the refrigerant enters the traditional expansion device immediately prior to the indoor evaporator.

17 Claims, 3 Drawing Sheets

REFRIGERATION SYSTEM EFFICIENCY ENHANCER

BACKGROUND OF THE INVENTION

1. Field of the Invention

This invention relates to a modified and improved refrigerant recycling refrigeration system or a retrofit alteration to an existing refrigeration system that enhances the system's cooling efficiency. Between an outdoor condenser and an indoor evaporator, a sub-cooler is provided including, immediately before the sub-cooler, but still within the high pressure liquid refrigerant portion of the system, a high flow, low pressure release check valve that serves as an incremental expansion device to cool partially the high pressure liquid refrigerant before the refrigerant enters the traditional expansion device immediately prior to the indoor evaporator.

2. Description of the Background Art

Devices relying on standard refrigerant recycling refrigeration technologies have been available for many years. Heat pump devices, having both cooling and heating capabilities, are included within the general scheme of the subject invention, however, the subject device relates preferably to refrigeration systems. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

Within the plumbing that couples the various refrigeration or heat pump components are three devices of particular import with the subject device. First, check valves are traditionally employed to prevent the backflow of refrigerant. For a heat pump, often check valves are configured to direct refrigerant down a desired path during the cooling cycle and a significantly different path during the heating cycle. Several types of check valves exist. A common check valve has a spring controlled gate that increase its resistance to refrigerant flow as the spring is displaced from its rest position. Gravity check valves function by having a ball or similar object forced by gravity into a receiving seat to block reverse flow of the refrigerant.

Second, expansion devices serve to divide the high pressure side of the system from the low pressure side of the system by feeding the liquid refrigerant to the evaporator at a rate that, hopefully, optimizes the efficiency of refrigerant vaporization. Therefore, the refrigerant pressure drops significantly across the expansion device and the flow of refrigerant is regulated or decreased to a desired level. Automatic (constant pressure), float and surge chamber (constant liquid level), and, preferably, thermostatic designs represent the three major types of expansion valves.

Third, traditional sub-coolers partially cool the refrigerant prior to the expansion device and subsequent evaporator. Such refrigerant cooling has been shown to increase the efficiency of the heat transfer within the evaporator. Various types of sub-coolers exist, but the most common form cools the refrigerant by drawing in cooler liquid to surround the warmer refrigerant.

Concerning existing references, specifically, U.S. Pat. No. 3,024,619 relates a heat pump system having an additional row of finned tubes on the condenser. Due to a first associated check valve, the additional finned tubes act as a sub-cooler during a cooling cycle. When the system is run in reverse direction for heating, a second check valve passes coolant through the auxiliary coil thereby increasing heating capacity during the heating cycle without adversely affecting cooling operation. No direct monitoring coolant temperatures or pressures are associated with the regulation of this process.

A reverse cycle refrigeration system is disclosed in U.S. Pat. No. 3,365,902. The apparatus acts as a heat pump or as a system having a normal refrigeration phase and a hot gas defrost phase. A set of heat source coils forming a distinct refrigerant circuit is separate from the condenser coils but contained in a common fin bundle with the condenser coils.

U.S. Pat. No. 3,537,274 provides a dual evaporator refrigeration system. The system permits alternate connection of the evaporators for cooling while using the liquid refrigerant as the source of heat for defrosting the disconnected evaporator. There are two separate evaporators and a four-way valve for alternately connecting one or the other evaporator to the outlet side of the expansion device. The other evaporator is connected in the liquid refrigerant flow line so that liquid refrigerant passes through it. This liquid refrigerant serves as the source of heat for defrosting the evaporator not being used. As the four-way valve switches, the actions of the evaporators switch.

Disclosed in U.S. Pat. No. 3,918,268 is a heat pump with a frost-free outdoor coil. A heating means is associated with the normal outside coil to prevent the surface temperature of the outside coil from falling below 32° C. Means are provided to prevent liquid floodback into the compressor when a changeover occurs from heating to cooling.

Described in U.S. Pat. No. 4,171,622 is a heat pump including an auxiliary outdoor heat exchanger acting as a defroster and sub-cooler. Located underneath the main outdoor heat exchanger and connected between the indoor and main outdoor heat exchangers is the auxiliary exchanger. During cooling the auxiliary exchanger acts as a sub-cooler and during heating it functions as a defroster for melting a block of ice that may have accumulated under or within the main outdoor heat exchanger. FIG. 1 indicates a check valve after the outdoor heat exchanger and prior to the sub-cooler, however, this check valve is merely to prevent, during the heating operation, the passage of refrigerant, thereby directing the refrigerant into the capillary tube (see column 4, lines 65–68).

U.S. Pat. No. 4,173,865 relates an auxiliary coil arrangement for a heat pump. The auxiliary coil is connected in parallel refrigerant flow arrangement with the expansion device of the heat pump. Standard check valves are provided to permit the auxiliary coil to function as a sub-cooler when the associated heat exchanger functions as a condenser.

Presented in U.S. Pat. No. 4,266,405 is a heat pump refrigerant circuit to reduce the time length of defrost cycles in contemporary air-to-air heat pumps. This reduction is accomplished by having two parallel refrigerant circuits connect the reversing valve to an outdoor coil. To regulate the direction of refrigerant flow, standard check valves are included.

A thermosyphon coil arrangement for a the outside unit of a heat pump is described in U.S. Pat. No. 4,449,377. When the heat pump is operating in the heating mode, the refrigerant flow is controlled by thermosyphoning action. Further, the coil placement and refrigerant flow are arranged for an outdoor unit so that the coil operates in an optimal thermosyphon fashion in the heating mode.

U.S. Pat. No. 4,553,401 discloses a reversible cycle heating and cooling system. Introduced is an auxiliary outdoor heat exchanger that is coupled with a water source for enhancing the capacity and efficiency of the system to transfer heat to the refrigerant during the heating mode at low outdoor ambient temperatures. A traditional check valve to water cooled refrigerant concentrator is indicated in both the cooling and heating cycles of the device.

A capillary tube-type expansion device for a heat pump is explained in U.S. Pat. No. 4,563,879. To regulate the device, a control unit detects the temperature of the outside air and the discharge water temperature of a water-cooled heat exchanger and applies a suitable control signal to an electrical expansion valve.

An apparatus for enhancing the performance of a heat pump is given in U.S. Pat. No. 4,761,964. First and second auxiliary coils are heated with associated radiant quartz heating elements. Outdoor temperature is employed, via a pair of thermostats, to regulate the operation of the quartz heaters.

Provided in Japanese Patent No. 38,143 is a heat pump type system having first and second units. The amount of cooling medium is regulated to provide maximum heating and cooling capacity.

Co-pending U.S. patent Ser. No. 07/660,141, filed on Feb. 21, 1991, discloses a supplemental heat exchanger system for a heat pump. Included is a receiver that acts to partially pre-cool the refrigerant by allowing the liquid refrigerant to expand slightly. Prior to the receiver is a check valve that prevents backflow during the heating cycle of the device.

SUMMARY OF THE INVENTION

An object of the present invention is to produce means for enhancing the cooling efficiency of a refrigeration system.

Another object of the present invention is to relate a means for slightly decreasing the pressure of high pressure liquid refrigerant within a refrigeration system to a pressure level that corresponds to a partially lowered temperature of the refrigerant, thereby enhancing the efficiency of the evaporation process.

A further object of the present invention is to disclose the use of a high flow, low pressure release check valve that serves in the novel role of an incremental expansion valve for partially lowering the pressure of high pressure liquid refrigerant within a refrigeration system.

An additional object of the present invention is to make an enhanced efficiency refrigeration system by employing at least one high flow, low pressure release check valve that serves in the novel role of an incremental expansion valve for partially lowering the pressure of high pressure liquid refrigerant within a refrigeration system in combination with a high pressure liquid refrigerant receiver that aids in sub-cooling the refrigerant before evaporation.

In association with a refrigerant recirculating refrigeration system having a compressor for generating high pressure gaseous refrigerant, a first heat exchanger for producing high pressure liquid refrigerant, a second heat exchanger for producing low pressure gaseous refrigerant, a first refrigerant flow line connecting the first and the second heat exchangers, and a refrigerant expansion valve located in the first flow line for generating the low pressure liquid refrigerant from the high pressure liquid refrigerant are disclosed means for enhancing the efficiency of the refrigeration system. Comprising the efficiency enhancing means is a block in the first refrigerant flow line between the first heat exchanger and the expansion valve, wherein the block prevents the direct flow of refrigerant from the first heat exchanger to the expansion valve and diverts the high pressure liquid refrigerant into a second flow line. Included is a first means, a high flow, low pressure release check valve, for incrementally lowering the pressure of the high pressure liquid refrigerant prior to the expansion valve, wherein the first incremental pressure lowering means is connected to the second flow line to accept liquid refrigerant after the first heat exchange. Additionally, a second means, a sub-cooler receiver, is provided for incrementally lowering the pressure of the high pressure liquid refrigerant, wherein the second incremental pressure lowering means receives refrigerant from the first incremental pressure lowering means and returns the refrigerant to the refrigeration system immediately before the expansion valve. Further, for large refrigeration systems, a third means, a high flow, low pressure release check valve, is supplied for incrementally lowering the pressure of the high pressure liquid refrigerant, wherein the third incremental pressure lowering means is connected between the second incremental pressure lowering means and the expansion valve.

Other objects, advantages, and novel features of the present invention will become apparent from the detailed description that follows, when considered in conjunction with the associated drawings.

DESCRIPTION OF THE PREFERRED EMBODIMENT

Figure 1:
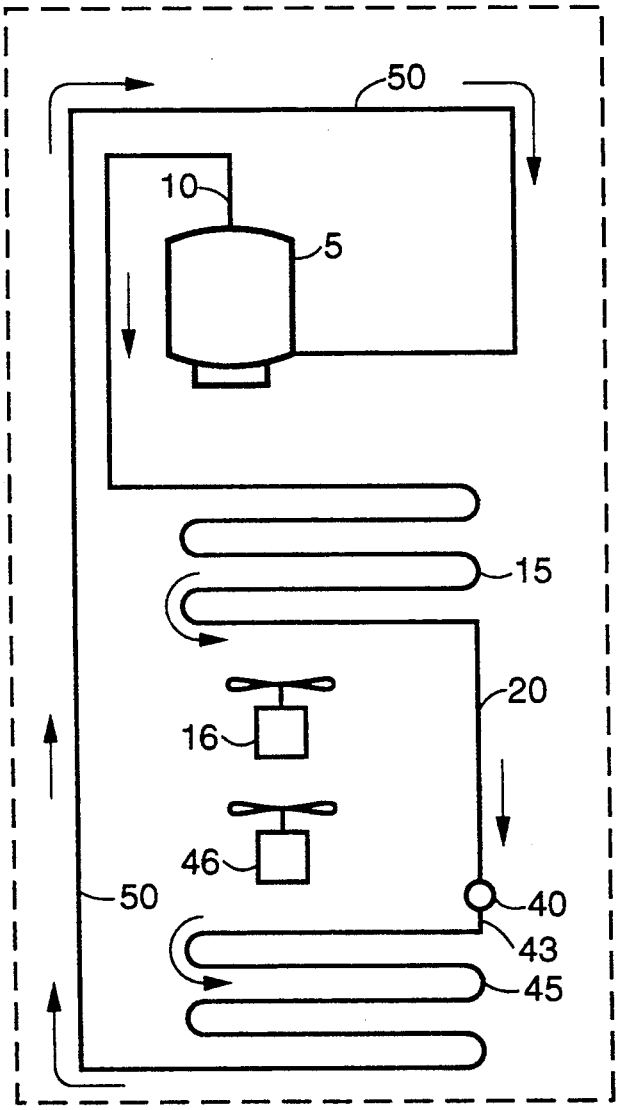
FIG.-1 PRIOR ART
FIG. 1 is a schematic diagram showing the flow of refrigerant during a typical heating cycle for a generalized prior art refrigeration system.

Referring now to FIG. 1 for a generalized refrigeration system, to quickly appreciate the benefits of the subject device, a brief description of the functioning of a refrigeration system is presented (see, FIG. 1). An expandable-compressible refrigerant is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. Even though the subject invention is used preferably with a refrigeration system, adaptation to a generalized heat pump system is considered to be within the realm of this disclosure. Therefore, for a heat pump, heating or cooling conditions are generated in the first and second environments by reversing the process within the enclosed system. For illustrative purposes only, cooling of a building is employed, but other environments such as those used with standard refrigeration units are considered to be within this disclosure.

As, indicated, FIG. 1 depicts a typical refrigeration system, but, again, it must be stressed that the subject invention is suitable for modifying any equivalent heat pumps systems in an analogous manner. A compressor 5 dispenses high pressure gaseous or vaporous refrigerant through flow line 10. After the high pressure expanded, vaporous, or gaseous refrigerant passes through flow line 10 it enters an outdoor heat exchanger or condenser 15. The high pressure gaseous refrigerant condenses into a liquid at high pressure and an elevated temperature. A blower or fan 16 aids in removing the warmed air that is released around the condenser 15 by the associated heat exchange.

The liquid refrigerant travels from the outdoor condenser 15 through flow line 20 to a controlled expansion within expansion device 40. Expansion device 40 separates the high pressure side of the refrigeration system from the low pressure side of the system and meters the proper amount of low pressure liquid refrigerant that enter flow line 43 for vaporization in the indoor heat exchanger or evaporator 45. Usually, the expansion device 40 is a thermostatic expansion valve (TX valve), but other equivalent means that convert high to low pressure liquid refrigerant are acknowledged as acceptable. Within the indoor evaporator 45 heat is taken on by the refrigerant (a blower or fan 46 aids in circulating the cooled air), which gasifies and returns via flow line 50 to the compressor 5. The returning refrigerant, via line 50, is at a lower pressure than the compressor exiting refrigerant, at line 10.

Figure 2:
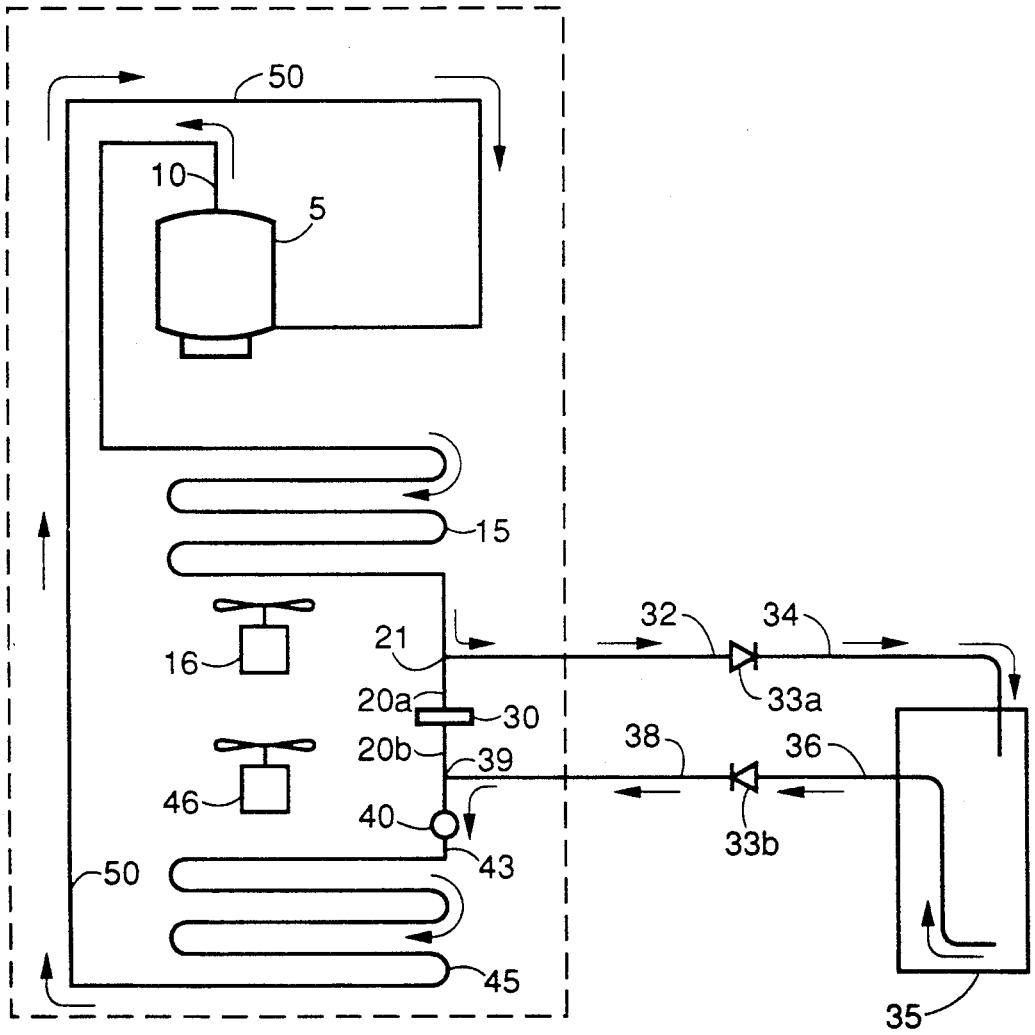
FIG. 2 is a schematic diagram showing the subject apparatus attached to the generalized refrigeration system of FIG. 1.
Figure 3:
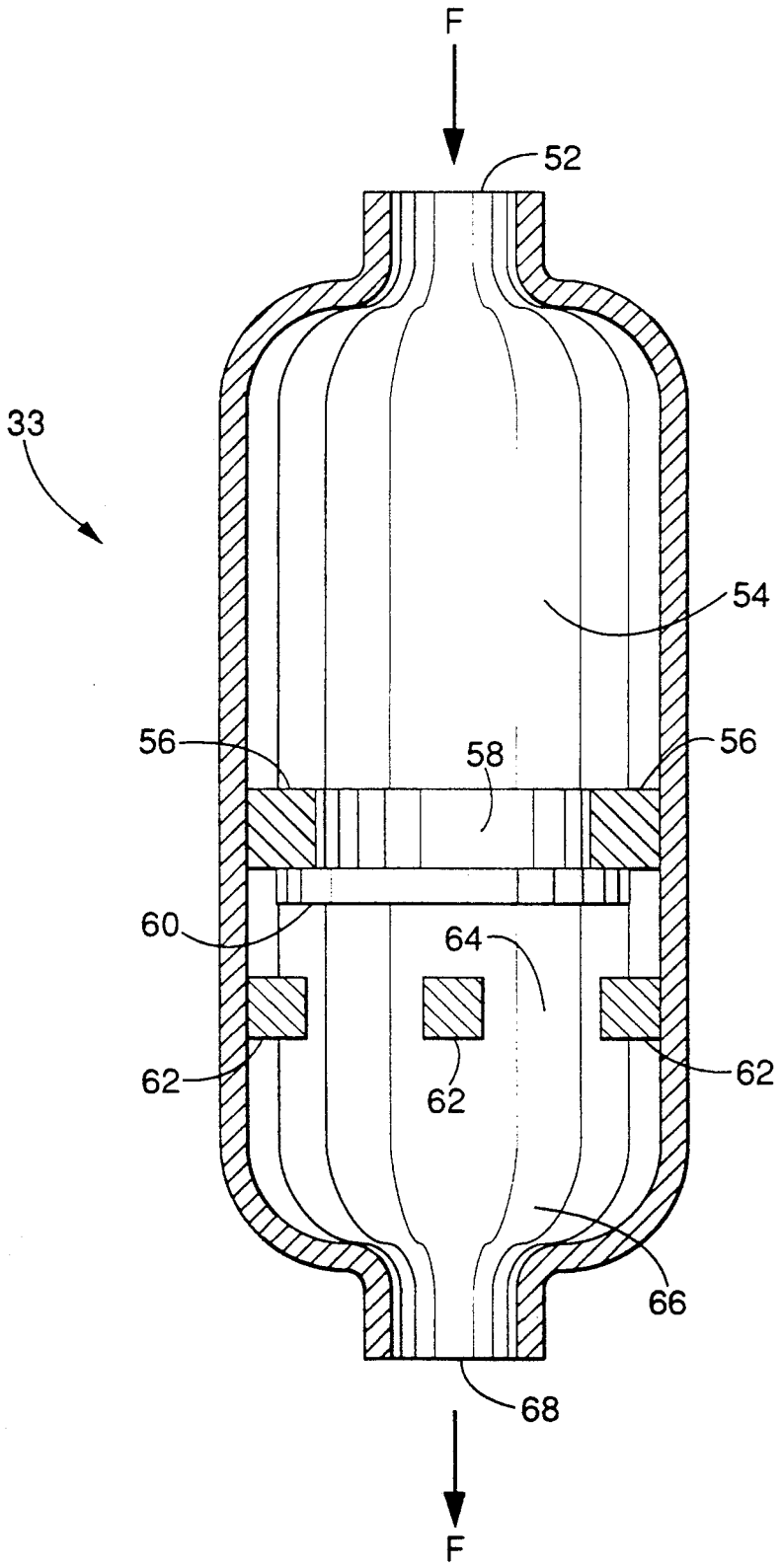
FIG. 3 is a cross-sectional view of a typical magnetic check valve that satisfies the conditions of a high flow, low pressure release check valve that serves as an incremental pressure lowering expansion valve in the subject invention.

FIGS. 2 and 3 indicate the components of the subject invention coupled into an existing refrigeration system. Even though the preferred method of use for the subject device is in the modification of a pre-existing refrigeration system, it must be stressed that the subject device applies equally well to the production of new heat pumps that incorporate the subject invention in their original design.

Specifically, FIG. 2 (applying the subject device to a pre-existing refrigeration system) shows that a clamp or block 30 has been introduced into flow line 20 that connects the outdoor 15 and indoor 45 heat exchangers. The block 30 completely prevents the refrigerant from directly passing the point at which the block 30 is attached. Any suitable method of blocking the line is contemplated, including a clamp, valve, weld, and the like. The original flow line 20 is split into new flow lines **20*a* (before the block 30) and 20*b* (after the block 30**).

To the evaporator 15 side of the block 30 is a T-joint or elbow 21 that permits the liquid refrigerant (condensed refrigerant after the outdoor condenser or heat exchanger 15) to flow from line **20*a* into flow line 32. Located in flow line 32 is a critical element of the subject device. Flow line 32 connects with means for sub-cooling the high pressure liquid refrigerant. Coupled with flow line 32 is a high flow, low release pressure check valve 33*a* (for the details of this valve, see below following the general overall system description). Since the main purpose of high flow, low release pressure check valve 33*a* is to permit a slight decrease in the pressure of the high pressure liquid refrigerant, check valve 33*a* (and equivalent component 33*b***, see below) is a type of incremental expansion valve that permits only a slight decrease in the high pressure of the liquid refrigerant before the TX valve allows normal high to low pressure conversion.

Following the high flow, low pressure release check valve **33*a* is flow line 34 that delivers high pressure liquid refrigerant into a receiver 35. The receiver 35 acts to partially sub-cool the refrigerant by allowing the liquid refrigerant to expand slightly. Following the receiver is a flow line 36 that carries the refrigerant through an optional high flow, low release pressure check valve 33*b*. It has been found that valve 33*a* (serving as an incremental expansion valve) is generally sufficient in sub-cooling refrigerant for refrigeration systems having a capacity of less than about three tons. However, a refrigeration system over about three tons capacity generally requires additional sub-cooling to significantly enhance its efficiency and in such cases valve 33*b*** (serving as a second incremental expansion valve) is included.

Following the optional valve **33*b* is a flow line 38 that connects, via a T-joint 39, with flow line 20*b* (block 30 split original flow line 20). The sub-cooled refrigerant passes into the TX valve 40. The TX valve 40 meters the drop to low pressure for the refrigerant and allows the evaporator 45** to vapor the refrigerant more efficiently.

Regulation of the temperature, when lowered, of the refrigerant before the TX (expansion) valve results in sub-cooling of the refrigerant and can significantly enhance the efficiency of the evaporation process. As noted above, the subject invention accomplishes the sub-cooling process by including at least one high flow, low release pressure check valve before the TX valve. Critical to the type of check valve employed for sub-cooling is that the configurational design of the selected check valve permit a high flow rate of refrigerant. Whenever a pressure drop occurs, without other contributing factors, across a standard, usually a spring type, check valve the refrigerant's temperature drops. However, a significantly decreased refrigerant flow rate occurs with such a high pressure (spring or equivalent forms) release check valve. The decreased flow rate is counter productive to any added sub-cooling since the compressor 5 needs to exert more energy to circulate the restricted refrigerant.

Incorporation of a check valve comprising a high flow rate is achieved by including a one-way mechanism that requires a low pressure of refrigerant to release the mechanism. Within the check is a control element that when displaced by the refrigerant's pressure permits the refrigerant to flow through the check valve. Generally, the control element has a frontside sealing surface and a backside surface. Preferably, the internal structure of the high flow, low release pressure check valve has a control element with a flat backside surface. As the high pressure liquid refrigerant flows past the flat backside of the control element (such as a disc, cone, or the like) a lowered pressure is created in a volume proximate the flat backside surface, thereby generating sub-cooling via a pressure difference.

It should be noted that as the outside temperature increases, the efficiency of the subject system increases. When the outside temperature goes up the condenser temperature increases, as does the compressor head pressure. The increased head pressure causes greater refrigerant flow, thereby increasing the differential high to low pressure sub-cooling behind the flat backside control element.

Typically, a high flow, low release pressure check valve regulated sub-cooling of the subject invention can result in dropping the temperature of the high pressure liquid refrigerant from about 102° F. to about 92° F. (the equivalent of approximately 30 pounds pressure). These numbers are by way of example only and not intended to limit the operational range of the subject invention.

Check valves that have high flow and low pressure release characteristics are useful with the subject device. However, as indicated above, preferred is a check valve with the internal control element (around which refrigerant flows and when set in place within the check valve blocks refrigerant flow) having a generally flat backside shape (disc, cone, and similar flat backside forms) is contemplated as acceptable by this disclosure. Backside is defined as the side of the control element that is downstream from the flowing refrigerant. In particular, a magnetic check valve is preferred with a disc or like control element. Once the initial release of the magnetic force is achieved, additional flow requires less energy. Such a valve is a Magni-Chek TM check valve produced by the Watsco, Inc. (Watsco, Inc., 615 W. 18th St., Hialeah, FL 33010). Except for the generally flat backside of the control element and the high flow characteristics, with low release pressure, the exact structure of the Watsco check valve is not critical to the subject invention. A generalized magnetic check valve is illustrated in FIG. 3. Various equivalent alternative forms are considered appropriate for the subject invention, however, comprising a typical magnetic check valve is a refrigerant entrance 52 (see refrigerant flow direction F). The refrigerant enters a chamber 54 and encounters a permanent magnet 56, usually of a donut type configuration, or equivalent form, fastened to the inside wall of the valve. Passing through the magnet 56 is at least one flow port 58. Magnetically secured to the magnet 56 is a valve plate 60 or suitably equivalent structure with an essentially flat backside to produce a low pressure volume in the flowing liquid refrigerant. Usually, when the refrigerant pressure is in the range of about 0.5 to about 2.0 psi, preferably about 1 psi, presses against the plate 60, from the refrigerant entrance side, the plate 60 is displaced and the refrigerant passes by the plate 60 and the low pressure volume is produced proximate the plate's 60 backside.

The plate 60 is retained by a valve plate stop 62, which may be present in several equivalent configurations. The released refrigerant travels past the plate stop 62 via one or more flow channels 64 and enters an exit chamber 66. Finally, the sub-cooled refrigerant leaves the valve via a refrigerant exit 68.

Although the foregoing invention has been described in some detail by way of illustration and example for purposes of clarity of understanding, it will be obvious that certain changes and modifications may be practiced within the scope of the appended claims.

What is claimed is:

1. In association with a refrigerant recirculating refrigeration system having a compressor for generating high pressure gaseous refrigerant, a first heat exchanger for producing high pressure liquid refrigerant, a second heat exchanger for producing low pressure gaseous refrigerant, a first refrigerant flow line connecting said first and said second heat exchangers, and a refrigerant expansion valve located in said first flow line for generating said low pressure liquid refrigerant from said high pressure liquid refrigerant, means for enhancing the efficiency of said refrigeration system, comprising:

a) a block in said first refrigerant flow line between said first heat exchanger and said expansion valve, wherein said block prevents the direct flow of refrigerant from said first heat exchanger to said expansion valve and diverts said high pressure liquid refrigerant into a second flow line;

b) first means for incrementally lowering the pressure of said high pressure liquid refrigerant prior to said expansion valve, wherein said first incremental pressure lowering means is connected to said second flow line to accept liquid refrigerant after said first heat exchanger; and c) second means for incrementally lowering the pressure of said high pressure liquid refrigerant, wherein said second incremental pressure lowering means receives refrigerant from said first incremental pressure lowering means and returns said refrigerant to said refrigeration system immediately before said expansion valve.

2. Means for enhancing the efficiency of said refrigeration system according to claim 1, further comprising third means for incrementally lowering the pressure of said high pressure liquid refrigerant, wherein said third incremental pressure lowering means is connected between said second incremental pressure lowering means and said expansion valve.

3. Means for enhancing the efficiency of said refrigeration system according to claim 1, wherein said first incremental pressure lowering means comprises a high refrigerant flow, low pressure release check valve.

4. Means for enhancing the efficiency of said refrigeration system according to claim 3, wherein said high refrigerant flow, low pressure release check valve comprises a one-way refrigerant flow mechanism that requires between about 0.5 psi and 2.0 psi to pass refrigerant.

5. Means for enhancing the efficiency of said refrigeration system according to claim 3, wherein said high refrigerant flow, low pressure release check valve comprises a one-way refrigerant flow mechanism having a control element with a generally flat backside to produce a low pressure volume proximate said backside as said liquid refrigerant flows past said control element, thereby causing sub-cooling of said liquid refrigerant.

6. Means for enhancing the efficiency of said refrigeration system according to claim 3, wherein said high refrigerant flow, low pressure release check valve comprises a one-way refrigerant flow mechanism having a permanent magnet and magnet attracted valve plate that requires between about 0.5 psi and 2.0 psi to pass refrigerant.

7. Means for enhancing the efficiency of said refrigeration system according to claim 3, wherein said high refrigerant flow, low pressure release check valve comprises a one-way refrigerant flow mechanism having a permanent magnet and magnet attracted valve plate that requires about 1 psi to pass refrigerant.

8. Means for enhancing the efficiency of said refrigeration system according to claim 1, wherein said second incremental pressure lowering means comprises a liquid refrigerant receiver.

9. Means for enhancing the efficiency of said refrigeration system according to claim 1, wherein said third incremental pressure lowering means comprises a high refrigerant flow, low pressure release check valve.

10. Means for enhancing the efficiency of said refrigeration system according to claim 9, wherein said high refrigerant flow, low pressure release check valve comprises a one-way refrigerant flow mechanism that requires between about 0.5 psi and 2.0 psi to pass refrigerant.

11. Means for enhancing the efficiency of said refrigeration system according to claim 9, wherein said high refrigerant flow, low pressure release check valve comprises a one-way refrigerant flow mechanism that requires about 1 psi to pass refrigerant.

12. Means for enhancing the efficiency of said refrigeration system according to claim 9, wherein said high refrigerant flow, low pressure release check valve comprises a one-way refrigerant flow mechanism having a permanent magnet and magnet attracted valve plate that requires between about 0.5 psi and 2.0 psi to pass refrigerant.

13. Means for enhancing the efficiency of said refrigeration system according to claim 9, wherein said high refrigerant flow, low pressure release check valve comprises a one-way refrigerant flow mechanism having a permanent magnet and magnet attracted valve plate that requires about 1 psi to pass refrigerant.

14. In association with a refrigerant recirculating refrigeration system having a compressor for generating high pressure gaseous refrigerant, a first heat exchanger for producing high pressure liquid refrigerant, a second heat exchanger for producing low pressure gaseous refrigerant, a first refrigerant flow line connecting said first and said second heat exchangers, and a refrigerant expansion valve located in said first flow line for generating said low pressure liquid refrigerant from said high pressure liquid refrigerant, means for enhancing the efficiency of said refrigeration system, comprising:

a) a block in said first refrigerant flow line between said first heat exchanger and said expansion valve, wherein said block prevents the direct flow of refrigerant from said first heat exchanger to said expansion valve and diverts said high pressure liquid refrigerant into a second flow line;

b) a first high refrigerant flow, low pressure release check valve for incrementally lowering the pressure of said high pressure liquid refrigerant prior to said expansion valve and said first check valve is connected to said second flow line to accept liquid refrigerant after said first heat exchange, wherein said check valve comprises a one-way refrigerant flow mechanism, wherein said check valve has a control element with a generally flat backside to produce a low pressure volume proximate said backside as said liquid refrigerant flows past said control element; and c) a liquid refrigerant receiver for incrementally lowering the pressure of said high pressure liquid refrigerant, wherein said refrigerant receiver accepts refrigerant from said first incremental pressure lowering means and returns said refrigerant to said refrigeration system immediately before said expansion valve.

15. Means for enhancing the efficiency of said refrigeration system according to claim 14, wherein said one-way refrigerant flow mechanism comprises a permanent magnet and a magnet attracted valve plate, wherein said valve plate is said generally flat backside control element.

16. Means for enhancing the efficiency of said refrigeration system according to claim 14, further comprising third means for incrementally lowering the pressure of said high pressure liquid refrigerant and said third incremental pressure lowering means is connected between said second incremental pressure lowering means and said expansion valve, wherein said check valve comprises a one-way refrigerant flow mechanism that requires between about 0.5 psi and 2.0 psi to pass refrigerant.

17. Means for enhancing the efficiency of said refrigeration system according to claim 16, wherein said one-way refrigerant flow mechanism comprises a permanent magnet and magnet attracted valve plate that requires said between about 0.5 psi and 2.0 psi to pass refrigerant.

* * * * *